US006941603B2

(12) United States Patent
Radice

(10) Patent No.: US 6,941,603 B2
(45) Date of Patent: Sep. 13, 2005

(54) CUSHIONING ELEMENT FOR MATTRESSES, PILLOWS AND THE LIKE

(75) Inventor: Sergio Radice, Novedrate (IT)

(73) Assignee: Gommagomma S.r.l., Caronno Pertusella (IT)

( * ) Notice: Subject to any disclaimer, the term of this patent is extended or adjusted under 35 U.S.C. 154(b) by 0 days.

(21) Appl. No.: 10/699,973

(22) Filed: Nov. 3, 2003

(65) Prior Publication Data

US 2005/0091750 A1 May 5, 2005

(51) Int. Cl.[7] ..... A47C 27/14; A61G 9/00
(52) U.S. Cl. ..... 5/730; 5/636; 5/655.9
(58) Field of Search ..... 5/730, 724, 725, 5/638, 690, 636, 655.9, 727

(56) References Cited

U.S. PATENT DOCUMENTS 2,659,418 A * 11/1953 Berman ..... 267/145
2,763,013 A * 9/1956 Van Valkenburgh ..... 5/652
3,885,257 A * 5/1975 Rogers ..... 5/730
4,335,476 A * 6/1982 Watkin ..... 5/730
6,668,404 B2 * 12/2003 Lanteri ..... 5/636

* cited by examiner

*Primary Examiner*—Alexander Grosz
(74) *Attorney, Agent, or Firm*—Pearne & Gordon LLP

(57) ABSTRACT

A cushioning element (1) such as a mattress or a pillow for beds and the like, consisting of a support surface (2) having at least one primary hole (5) provided with at least two portions consecutive to each other in longitudinal section. The portions (5*a*, 5*b*) have different cross-section widths and are separated from each other by a transition region. The element (1) further has a base surface (3) opposite to said support surface (2), in which a secondary hole (7) is formed.

8 Claims, 3 Drawing Sheets

FIG 3
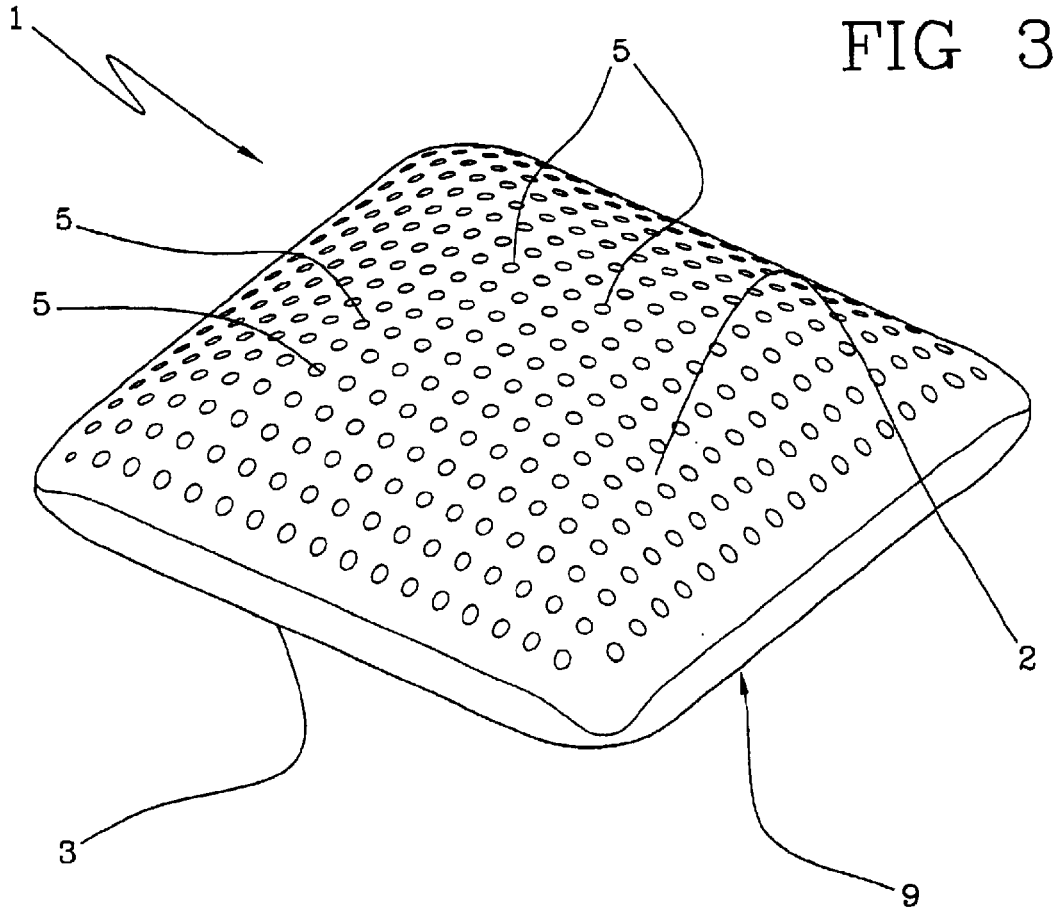
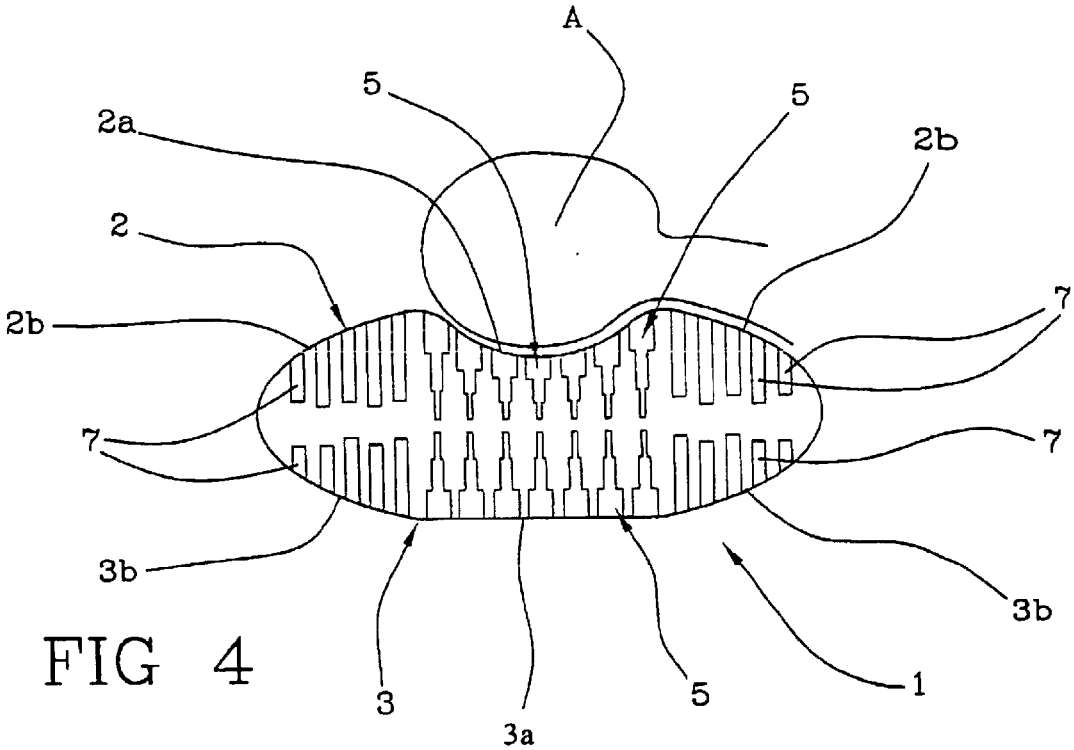
FIG 4

CUSHIONING ELEMENT FOR MATTRESSES, PILLOWS AND THE LIKE

FIELD AND BACKGROUND OF THE INVENTION

The present invention relates to a cushioning element for mattresses, pillows and the like. In particular, it regards a cushioning element such as a slab for mattresses or pillows made of latex and employable in beds, sofas, etc.

It is known that cushioning elements, such as slabs for mattresses made of latex, are monolithic items having a plate-like conformation with a parallelepiped extension; the mattress has an upper surface to support a user's body and a lower surface adopted to rest on the bed frame.

These mattresses are manufactured using a raw material (latex) converted from a liquid state to a foamy state and successively converted to a solid state by vulcanization.

By virtue of the particular elastic properties of the mattress material, the latter conforms in shape with the user's shape and weight. In this way, the user's prominent and heavy body parts sink into the upper surface of the mattress in an attempt to keep the user's backbone in a correct horizontal posture.

Likewise, pillows are made with the same techniques used for mattresses and perform analogous tasks.

Indeed later pillows conform their shape to the user's skull separating also on the skull's weight, keeping the cervical vertebrae to a correct posture.

Pillows and mattresses having a series of dead holes at the respective lower and/or upper surfaces are also known.

These holes have a frustoconical conformation tapering inwardly of the mattress or pillow and allow to obtain a constantly increasing stiffness as the user's weight increases.

In addition, in order to define regions of greater density, i.e. mattress or pillow regions adapted to receive heavier weights (e.g. regions corresponding to the user's shoulders and pelvis), the overall holes' number or diameter is increased or decreased. In this way the cushioning and deformation capability of the upper surface in contact with the user is further improved.

The above described cushioning elements however have some drawbacks or operating problems.

Actually it is impossible to change the cushioning element's density as a function of the element thickness, depending on the user's weight.

Indeed, due to the conformation of said known holes, the density of the cushioning element cannot be varied in a discrete manner.

In particular, the known hole conformation which consists in tapering away from the user's support surface, only enables the density of the cushioning element to be increased in an incremental manner as the weight increases.

Consequently, owing to the user's weight the cushioning element has a tendency to assume excessive concavity sometimes causing an excessive sinking of the user's body thereinto.

Under this situation, the user could find himself/herself in a non optimal condition.

SUMMARY OF THE INVENTION

Accordingly, it is an object of the present invention to manufacture a cushioning element for mattresses and pillows solving the above mentioned problems.

In particular, it is an aim of the present invention to manufacture a cushioning element to be used in mattresses and pillows in which the density of the element itself is varied in a discrete manner along the thickness thereof.

More in detail, it is an aim of the present invention to provide for a cushioning element having differentiated density values so that it can bear any weight applied locally by the user, irrespective of the support region and the weight value.

It is another aim of the present invention to provide for a mattress and a pillow capable of solving the above mentioned problem.

The foregoing and still further aims are achieved by a cushioning element for mattresses, pillows and the like comprising the features set out in the set of claims.

BRIEF DESCRIPTION OF THE DRAWINGS

Further features and advantages will be understood from the detailed description of a preferred, but not exclusive, embodiment of a cushioning element for a mattress and a pillow in accordance with the present invention. This description will be set forth hereinafter with reference to the accompanying drawings, given by way of non-limiting example, in which:

FIG. 3 is a perspective view of a cushioning element in accordance with a second embodiment of the present invention;

FIG. 4 is an elevation side view in section of the cushioning element shown in FIG. 3 in a use condition;

DESCRIPTION OF THE PREFERRED EMBODIMENTS

Figure 1:
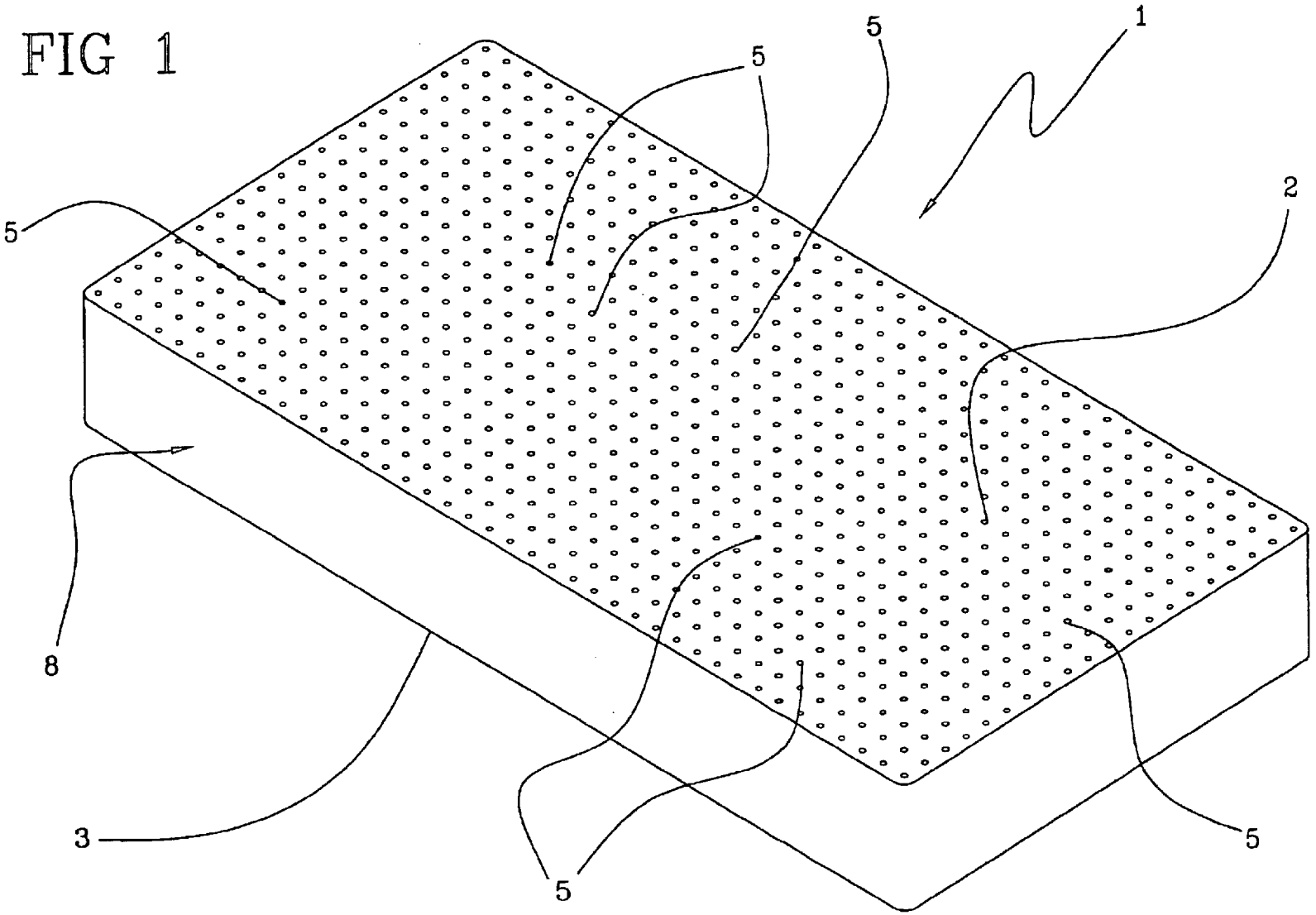
FIG. 1 is a perspective view of a cushioning element in accordance with a first embodiment of the invention.

With reference to the drawings, a cushioning element for mattresses, pillows and the like in accordance with the invention has been generally identified by reference numeral 1.

Figure 2:
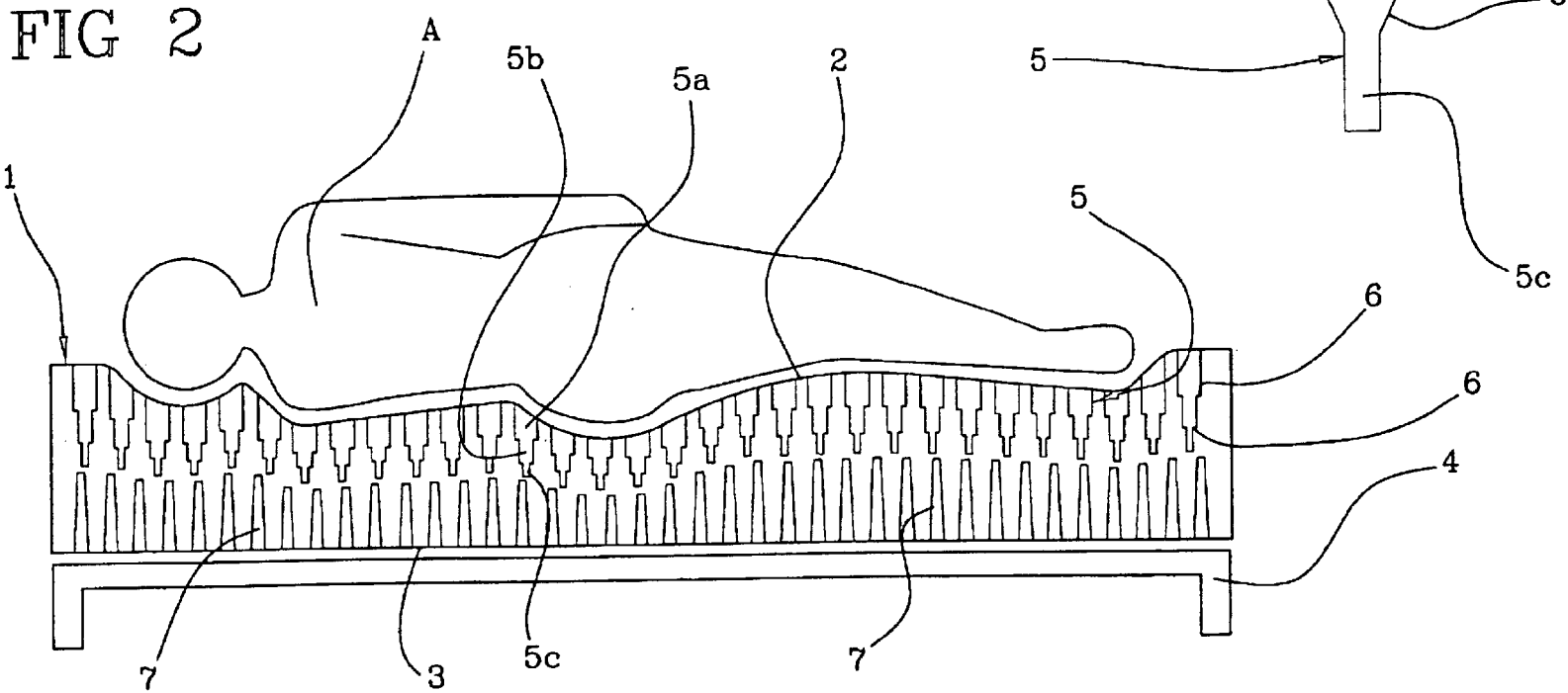
FIG. 2 is an elevation side view in section of the cushioning element shown in FIG. 1 in a use condition.

Referring to FIGS. 1 and 2 showing a first embodiment, the cushioning element 1 has a main body 8 of substantially plate-like conformation having a rectangular perimeter extension.

Preferably, the cushioning element 1 is internally made of latex and has a horizontal support surface 2 designed to bear the body of a user A (see FIG. 2), and a base surface 3, opposite to the support surface 2 and designed to rest on the frame 4 of a bed.

At least one primary hole 5 consisting of at least two portions 5*a*, 5*b* consecutive to each other is formed in the support surface 2.

In more detail, still with reference to FIG. 2, element 1 has a plurality of primary holes 5 disposed on at least a part of the support surface 2 and preferably along the whole support surface 2 itself.

The number and arrangement of the primary holes 5 may vary depending on the density to be given to the support surface 2 along the plane. For example, regions of the support surface 2 having a greater number of holes 5 may be provided, so that density on the surface 2 itself can be changed.

In particular, each hole 5 (shown in detail in FIG. 5) that is advantageously a dead hole, has at least three portions 5*a*, 5*b*, 5*c* consecutive to each other, each of them having a different cross-section width. Portions 5*a*, 5*b*, 5*c* are coaxial with each other and between one of said portions 5*a*, 5*b*, 5*c* and the respective adjacent portion a transition region 6 extends.

More particularly, portions 5*a*, 5*b*, 5*c* have a cylindrical conformation with a circular base and their cross-section width (diameter) respectively decreases on moving from the first to the third portion.

In other words, portion 5*a* that is close to the support surface 2 has a cross-section width greater than the middle portion 5*b* that in turn has a greater size than the distal portion 5*c*, with respect to the support surface 2.

Figure 5:
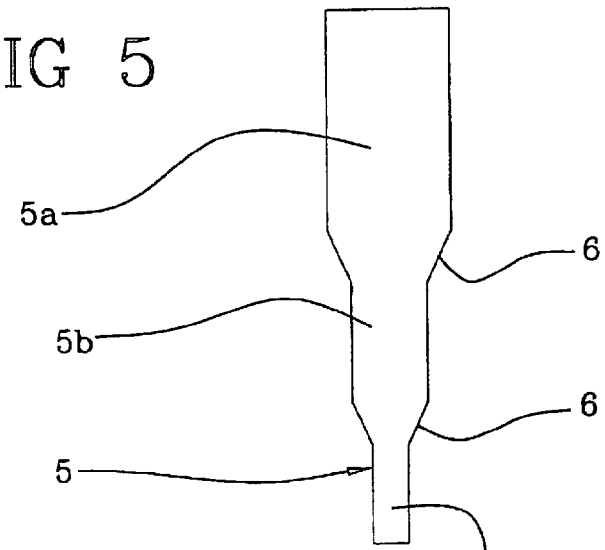
FIG. 5 is a diagrammatic view of a primary hole provided in the cushioning element.

The transition region 6 can be of a shape tapering away from the support surface 2, as shown in detail in FIG. 5, so as to define flared section variations.

Moreover, in correspondence of the base surface 3 at least one secondary dead hole 7 is formed.

Advantageously, a plurality of secondary holes 7 may be provided; such secondary holes 7 may be at least partly formed on the base surface 3.

Each secondary hole 7 has a substantially frustoconical extension in longitudinal section, tapering away from the base surface 3.

Referring to FIGS. 3 and 4 in showing the second embodiment, the cushioning element 1 has a prismatic conformation with a rectangular perimetral extension.

In more detail, the support surface 2 is at least partly rounded and designed to hold up the head of user A.

Advantageously, both the support surface 2 and base surface 3 are convex as better shown in FIG. 4.

The support surface 2 may have several convex regions so as to show a predetermined undulation. This undulation varies depending on the physical features of user A and on the construction requirements (e.g. the shape of the anatomic pillows present on the market).

The support surface 2 too is at least partly provided with a plurality of primary holes 5 of the type described above in detail.

As shown in FIG. 4 by way of example only, the support surface 2 has a central region 2*a* in which said primary holes 5 are formed and a contour region 2*b* in which the secondary holes 7 are formed. In accordance with this embodiment, holes 7 have a constant and substantially cylindrical extension in longitudinal section.

Alternatively, the secondary holes 7 may also have a frustoconical extension as previously described.

The base surface 3 may also be provided with said primary holes 5 at a central region 3*a* thereof and with the secondary holes 7 at a contour region.

The present invention also refers to a mattress of the type having a laminar conformation with a rectangular peripheral extension. Said mattress comprises the cushioning element 1 of the above described type.

Advantageously, as shown in FIG. 1, the mattress is made up of the cushioning element 1 (possibly with a cover thereon) in accordance with the first embodiment shown in FIGS. 1 and 2.

In addition, the present invention also refers to a pillow 9 of a prismatic conformation with a rectangular peripheral extension. The pillow comprises the cushioning element 1 in accordance with the second embodiment described above.

Preferably, as shown in FIGS. 3 and 4, pillow 9 is made up of the cushioning element 1 (possibly with a cover thereon).

Advantageously, the cushioning element 1 has a support surface 2 with a varying density based on user A's weight.

The cushioning element density derives from the particular conformation of the primary holes 5. Indeed, portions 5*a*, 5*b*, 5*c* have different sections and therefore different resistance to pressure, so that, along their thickness, each portion is deformable depending on a preestablished pressure value.

In this way when a given pressure is applied to the support surface 2, the proximal portion 5*a* that is wider and therefore less resistant, undergoes a strong deformation along its longitudinal extension until region 6 separating portion 5*a* from the consecutive median portion 5*b*. Consequently the deformations to which the second portion 5*b* is submitted will be much smaller.

However, if a high pressure is exerted the middle portion 5*b* too is fully deformed until region 6 separating said median portion 5*b* from the distal portion 5*c*.

Assuming that a very high pressure is exerted, the distal portion 5*c* too will be greatly deformed. In other words, three density levels are defined that correspond to portions 5*a*, 5*b*, 5*c*, each of them having a deformability value of its own.

For example, with reference to FIG. 2, the body parts of user A of greater weight appear to be supported by the middle portion 5*b* or distal portion 5*c*, whereas the lighter body parts lie on a level close to the support surface 2.

Likewise, also in the case shown in FIG. 4, the head-rest areas that bear a greater weight portion are held up by the support surface 2 at a distal level thereof whereas the lighter areas (such as the neck-supporting area) are held up by the support surface 2 at a level close thereto.

The present invention solves the drawbacks of the known art and achieves the intended purposes.

Indeed, giving the possibility to differentiate the density of the support surface 2 in a discrete manner (so as to adapt it to the user's weight) allows a correct positioning of the user's body.

The body of user A does not sink into the cushioning element 1 in an undifferentiated manner, but it is supported by different elastic reactions of element 1 resulting from different densities of the different regions.

Advantageously, the user's backbone is always maintained in substantial horizontal layout, whereas the heavier parts such as the pelvis or shoulders of user A penetrate deeper in the mattress, close to the middle portion 5*b* or to the distal portion 5*c*.

Likewise, in the embodiment of FIG. 4 too, the backbone's cervical vertebrae keep a correct position resting in alignment on the support surface 2.

Consequently the back of user A keeps a correct posture and the support surface 2 adjusts itself following the user's profile without excessive yielding.

What is claimed is:

1. A mattress comprising:

a parallelepiped main body at least partly made of latex, the parallelepiped main body having a support surface provided with a plurality of primary holes with an axial extension transverse to the support surface, the primary holes comprising, from the support surface towards an inside of the mattress, a first portion, a second portion and a third portion, consecutive to each other, each having a cylindrical conformation and a circular cross section, the primary holes also comprising two transition regions placed between said first portion and second portion and between said second portion and third portion respectively, the first portion being placed in correspondence of the support surface and having a circular cross section with a diameter greater than the diameter of the circular cross section of the second portion, the second portion having a diameter greater than the diameter of the circular cross section of the third portion, the transition region placed between said first portion and second portion presenting a cross section progressively decreasing from the first portion towards the second portion, the transition region between the second portion and the third portion presenting a cross section progressively decreasing from the second portion towards the third portion.

2. Mattress as claimed in claim 1, wherein said primary holes are dead holes.

3. Mattress as claimed in claim 1, wherein the parallelepiped main body has a base surface opposite to the support surface, the base surface being provided with a plurality of secondary holes of a frustoconical extension and tapering away from said base surface.

4. A prismatic pillow having a rectangular peripheral conformation comprising:

a main body at least partly made of latex, the main body having a support surface provided with a plurality of primary holes with an axial extension transverse to the support surface, the primary holes comprising, from the support surface towards an inside of the prismatic pillow, a first portion, a second portion and a third portion, consecutive to each other, each having a cylindrical conformation and a circular cross section, the primary holes also comprising two transition regions placed between said first portion and second portion and between said second portion and third portion respectively, the first portion being placed in correspondence of the support surface and having a circular cross section with a diameter greater than the diameter of the circular cross section of the second portion, the second portion having a diameter greater than the diameter of the circular cross section of the third portion, the transition region placed between said first portion and second portion presenting a cross section progressively decreasing from the first portion towards the second portion, the transition region between the second portion and the third portion presenting a cross section progressively decreasing from the second portion towards the third portion.

5. Prismatic pillow as claimed in claim 4, wherein said primary holes are disposed at a central area of said prismatic pillow.

6. Prismatic pillow as claimed in claim 4, wherein the main body has a base surface opposite to the support surface, the base surface being provided with a plurality of secondary holes of a frustoconical extension and tapering away from said base surface.

7. Prismatic pillow as claimed in claim 6, wherein said secondary holes are disposed in a contour area of said prismatic pillow.

8. A cushioning element for mattresses, pillows or cushions comprising:

a support surface provided with a plurality of primary holes with an axial extension transverse to the support surface, the primary holes comprising, from the support surface towards an inside of the cushioning element, a first portion, a second portion and a third portion, consecutive to each other, each having a cylindrical conformation and a circular cross section, the primary holes also comprising two transition regions placed between said first portion and second portion and between said second portion and third portion respectively, the first portion being placed in correspondence of the support surface and having a circular cross section with a diameter greater than the diameter of the circular cross section of the second portion, the second portion having a diameter greater than the diameter of the circular cross section of the third portion, the transition region placed between said first portion and second portion presenting a cross section progressively decreasing from the first portion towards the second portion, the transition region between the second portion and the third portion presenting a cross section progressively decreasing from the second portion towards the third portion.

* * * * *